US007097130B2

(12) United States Patent
Usui et al.

(10) Patent No.: US 7,097,130 B2
(45) Date of Patent: Aug. 29, 2006

(54) TAPE PACK APPEARANCE CONTROL APPARATUS

(75) Inventors: Mitsunobu Usui, Kanagawa (JP); Akio Yamaguchi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/677,248

(22) Filed: Oct. 3, 2003

(65) Prior Publication Data

US 2004/0075013 A1 Apr. 22, 2004

(30) Foreign Application Priority Data

Oct. 4, 2002 (JP) ..... 2002-292420

(51) Int. Cl.
*B65H 23/04* (2006.01)

(52) U.S. Cl. ..... 242/548.3; 242/615

(58) Field of Classification Search ..... 242/548.2, 242/548.3, 548.4, 615
See application file for complete search history.

(56) References Cited

U.S. PATENT DOCUMENTS 4,909,455 A * 3/1990 Sakaguchi et al. ..... 242/548.4
5,028,012 A * 7/1991 Kita ..... 242/548.4
5,261,621 A * 11/1993 Sakaguchi et al. ..... 242/548.4
5,533,690 A * 7/1996 Kline et al. ..... 242/548.2
6,045,086 A * 4/2000 Jeans ..... 242/548.3
6,450,438 B1 * 9/2002 McAllister et al. ..... 242/548.3
6,508,431 B1 * 1/2003 Gavit ..... 242/548.3
6,719,238 B1 * 4/2004 Grant et al. ..... 242/548.4

FOREIGN PATENT DOCUMENTS

JP 2000-36180 A 2/2000

* cited by examiner

*Primary Examiner*—William A. Rivera
(74) *Attorney, Agent, or Firm*—Sughrue Mion, PLLC

(57) ABSTRACT

An apparatus that improves the appearance of a tape being wound on a tape reel includes a tissue which is positioned in parallel to an inner surface of a flange of the tape reel and pushes the tape edge against the inner surface. In this apparatus, the reel-up of the tape is performed while moving the tissue in the same direction as the reel-up direction of the tape or performed without moving the tissue.

14 Claims, 6 Drawing Sheets

TAPE PACK APPEARANCE CONTROL APPARATUS

BACKGROUND OF THE INVENTION

1. Field of the Invention

The present invention relates to a tape pack appearance control apparatus. More specifically, the present invention relates to an apparatus that improves the appearance of a tape pack by controlling the reel-up of a tape. Here, the form taken by the tape after it is wound onto the tape reel is called the tape pack.

2. Description of Relevant Art

Conventionally, the winding control technique, which is a technique to be performed in order to prevent the occurrence of the distortion of the shape of the tape pack when a tape is wound onto a tape reel, has been known.

FIG. 5 is a cross sectional view of a tape reel, in which the tape T is being wound onto the reel hub 51 by using a conventional reel-up manner of a tape T.

As shown in FIG. 5, a tissue 10 is positioned between the flanges 52 and 53 of the tape reel 50.

In this tape reel 50, the meandering of the tape T is controlled by flanges 52 and 53 and the tissue 10 that prevent the excessive slip in the width directions of the tape T.

To be more precise, as shown in FIG. 5, when the slip of the tape T occurs, the inner surface 53*a* of the flange 53 comes in contact with the tape edge E1 of the tape T and controls the position of the tape edge E1 of the tape T, and the tissue 10 comes in contact with the tape edge E2 in the flange 52 side of the tape T and controls the position of the tape edge E2 of the tape T. Thereby, the excessive slip in the width directions of the tape T is controlled.

In this tape reel 50, the inner surface 52*a* is not in parallel to the outer surface 52*b*, and the inner surface 53*a* is not in parallel to the outer surface 53*b*. That is, the inner surface 52*a* and the inner surface 53*a* are inclining with respect to the outer surface 52*b* and the outer surface 53*b*, respectively. In other words, the distance between an inner surface 52*a* and the inner surface 53*a* becomes wider toward the circumference of the tape reel 50.

In this tape reel 50, the inner surface 52*a* and the inner surface 53*a* are slanting with respect to the outer surface 52*b* and the outer surface 53*b*, respectively. Thus, the smooth guide of the tape T into the region between the flanges 52 and 53 can be achieved when performing the reel-up of the tape T.

Additionally, the smooth draw-out of the tape T from the tape reel 50 can be achieved. Thereby, the reel-up and draw-out of the tape T are stably performed.

As described above, the smooth travel of the tape T is allowed by controlling the slip in the width directions of the tape T by using the tissue 10 and the flange 53. Thereby, since the positional accuracy of the tape T is improved, the superior recording and reproducing characteristics of the tape T can be brought out.

As an example of the conventional tape pack appearance control apparatus, the apparatus disclosed in Japanese unexamined Japanese patent publication JP2000-036180 can be cited. In this apparatus, almost all of the slip of the tape is controlled by providing a liner sheet.

In this conventional tape pack appearance control apparatus, since the distance between inner surfaces in the vicinity of the periphery of flange is larger than that in the vicinity of the reel hub, the occurrence of the distortion of the shape of the tape pack cannot be fully prevented.

Therefore, there have been requirements of an apparatus that improves the appearance of a tape pack being wound around a tape reel by controlling the reel-up of a tape.

SUMMARY OF THE INVENTION

The present invention relates to an apparatus that improves the appearance of a tape being wound on a tape reel. This apparatus includes a tissue which is positioned in parallel to an inner surface of a flange of the tape reel and pushes the tape edge against the inner surface. In this apparatus, the reel-up of the tape is performed while moving the tissue in the same direction as the reel-up direction of the tape or performed without moving the tissue.

In this apparatus, the tissue is placed in parallel with the inner surface of the flange of the tape, and the tissue is allowed to travel in the same direction as the reel-up direction of the tape in the condition that the tape edge of the tape is pushed against the inner surface.

That is, since the reel-up of the tape is performed while controlling the position of the edge of the tape by the tissue and the flange, the occurrence of the distortion of the shape of the tape pack can be reduced.

In the present invention, it is preferable that the distance between the tissue and the inner surface of the flange becomes progressively narrow as the tape moves in parallel to the inner surface of the flange.

In this case, since the downstream side of the traveling direction of the tape T is pushed toward the flange with a greater force than upstream side of the tape T, the sufficient prevention of the occurrence of the distortion of the shape of the tape pack can be obtained.

DETAILED DESCRIPTION OF THE PREFERRED EMBODIMENT

The preferred embodiment of the present invention will be explained with reference to the attached drawings.

Figure 1:
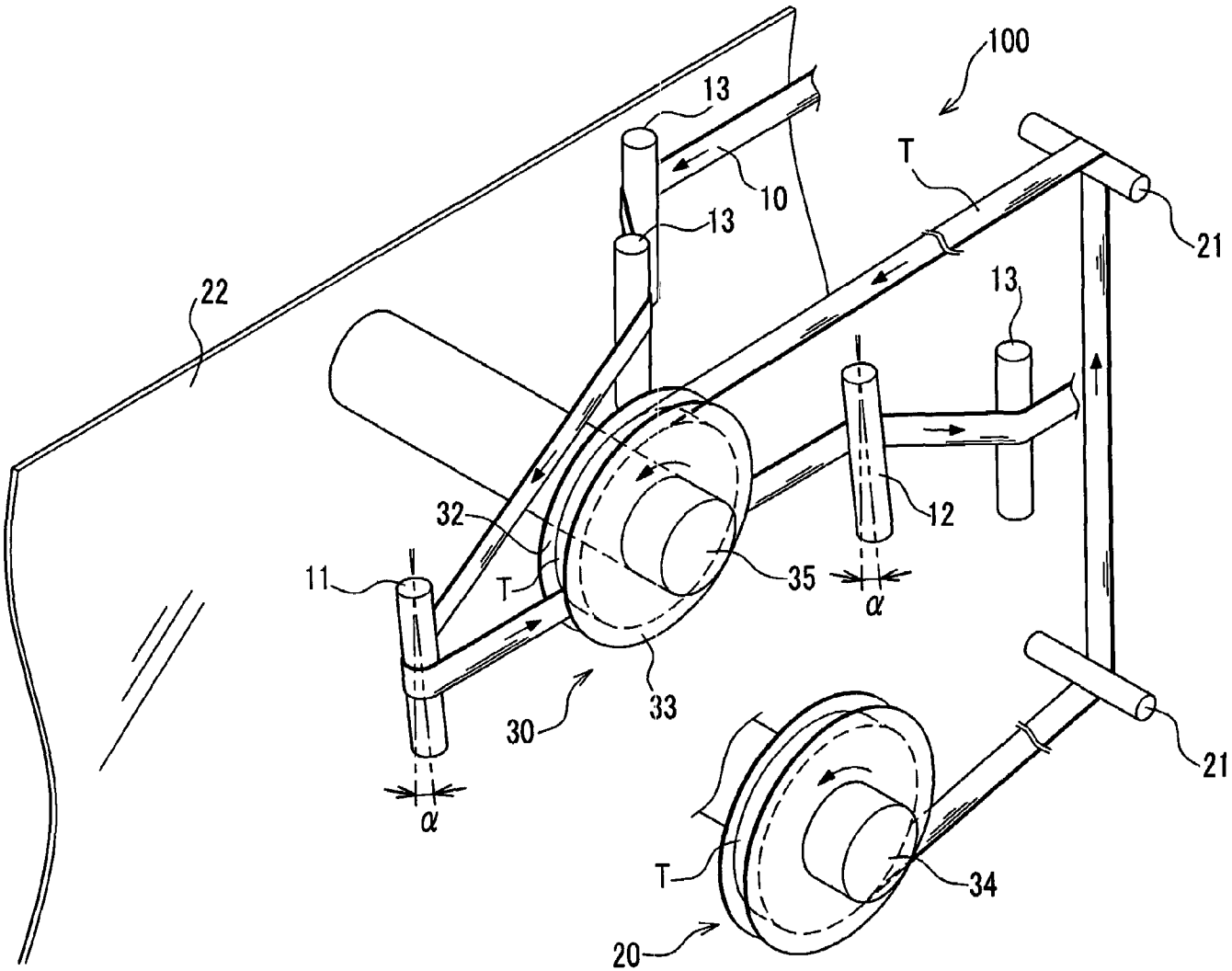
FIG. 1 is a perspective schematic view of a tape pack appearance control apparatus according to the present invention.

As shown in FIG. 1, a tape pack appearance control apparatus 100 that improves the appearance of the tape pack of the magnetic tape T includes a pancake 20, a tape reel 30, and a tissue 10. Here, a clump of magnetic tape T, which is roughly being wound around the reel and is obtained from the raw magnetic tape, is called as a pancake.

In this apparatus 100, the magnetic tape T fed out from the pancake 20 is wound around the tape reel 30. In this occasion, the tissue 10 passes the region between the flanges 32 and 33 of the tape reel 30 so that the tissue 10 may be located below a fixator 35 and can push the magnetic tape T against the flange 33. Thus, the control of the appearance of the tape pack is achieved.

In the tape pack appearance control apparatus 100, a plurality of guide rollers are provided.

A guide roller 21 supports the magnetic tape T fed out from the pancake 20 and gives the tensile force on the magnetic tape T. Thereby, since the slip of the magnetic tape T is controlled by the tensile force, the reel-up of the magnetic tape T to the tape reel 30 is allowed with superior positional accuracy.

The guide roller 11 and the guide roller 12 support the tissue 10, and guide the tissue 10 to the region between flanges 32 and 33 so that the tissue 10 may pass a lower side than the fixator 35. In the present embodiment, therefore, guide rollers 11 and 12 are provided so that the tape reel 30 is positioned between guide rollers 11 and 12. Thereby, the tissue 10 is positioned between flanges 32 and 33 in the condition that the suitable tensile force is being applied to the region between guide rollers 11 and 12 of the tissue 10.

In the present embodiment, the traveling direction of the tissue 10 is turned in the opposite direction by the guide roller 11. Then, the tissue 10 whose traveling direction was turned reaches at the guide roller 12 through the region between the flange 32 and the flange 33.

Guide rollers 13 apply a sufficient tensile force to the tissue 10. Thereby, the smooth and accurate guide of the tissue 10 toward the guide roller 11 and the smooth and accurate guide of the tissue 10 from the guide roller 12 are allowed by the tensile force being applied to the tissue 10. In the present invention, therefore, pluralities of guide rollers 13 are provided along the pathway of the tissue 10.

In this tape pack appearance control apparatus 100, as shown in FIG. 1, the tissue 10 moves in the same direction with respect to the traveling direction of the magnetic tape T when the tissue 10 passes through the region between flanges 32 and 33.

The tape reel 30 which performs the reel-up of the magnetic tape T rotates in a counterclockwise direction. Thus the magnetic tape T travels in the direction shown by arrow. Thus, the tissue 10 travels in the same direction with respect to the moving direction of the magnetic tape T when the tissue 10 passes through the region between flanges 32 and 33.

Figure 6:
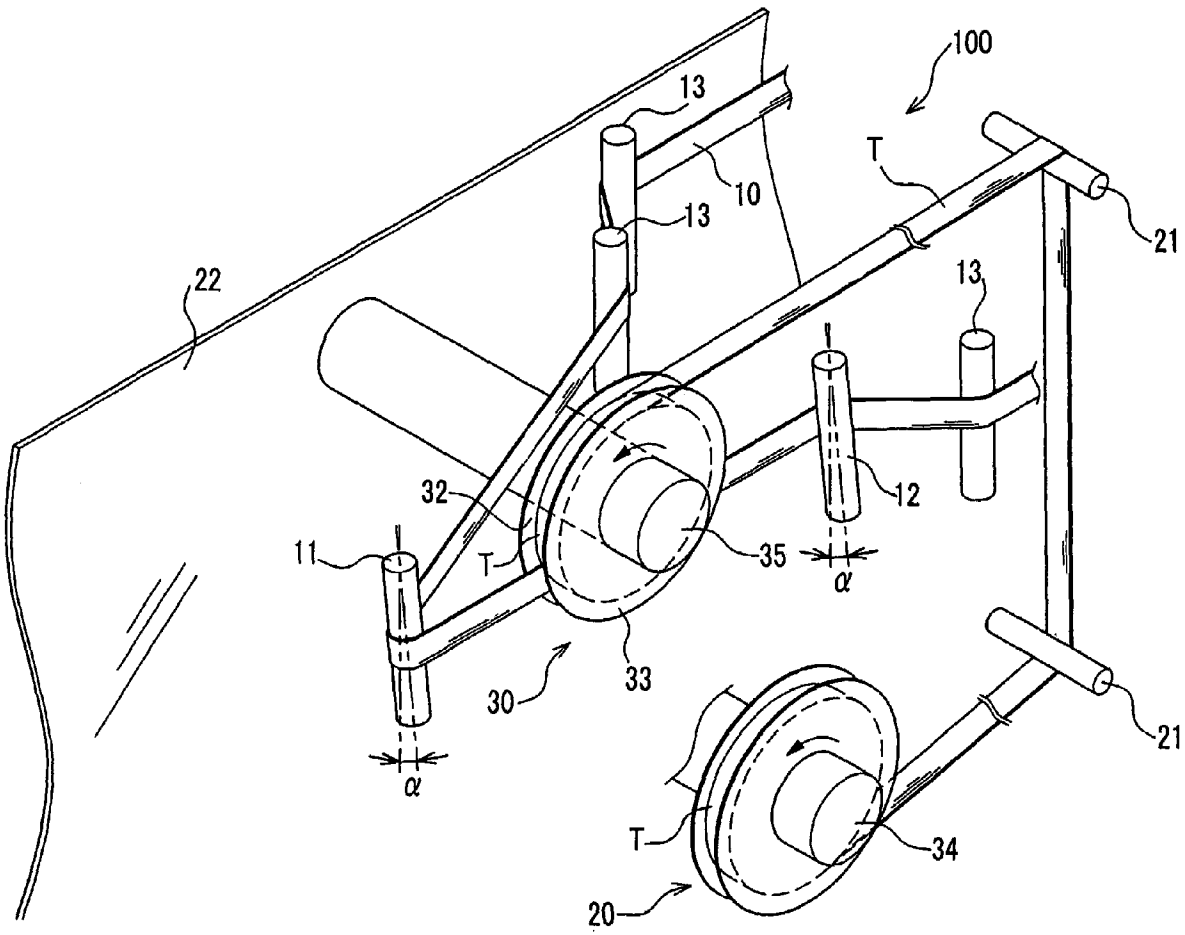
FIG. 6 is a perspective schematic view of a tape appearance control apparatus according to an exemplary embodiment of the present invention.

In an exemplary embodiment, as illustrated in FIG. 6, the reel-up of the magnetic tape T is performed while pushing the magnetic tape MT to the inner surface 33*a* of the flange 33 by the tissue 10 without moving the tissue 10. The tissue 10 is moved rightwardly in FIG. 1 at a predetermined length after the reel-up of the magnetic tape MT is terminated.

In the present embodiment, additionally, the reel-up of the tissue 10 may be performed while moving the tissue. In this case, the traveling speed of the tissue 10 may be established at the same speed as the reel-up speed of the magnetic tape T or may be established at slower or faster speed than the reel-up speed of the magnetic tape T. Here, the tissue 10 is a tape made of a thin paper, a finished fabric, or a nonwoven fabric.

Figure 3:
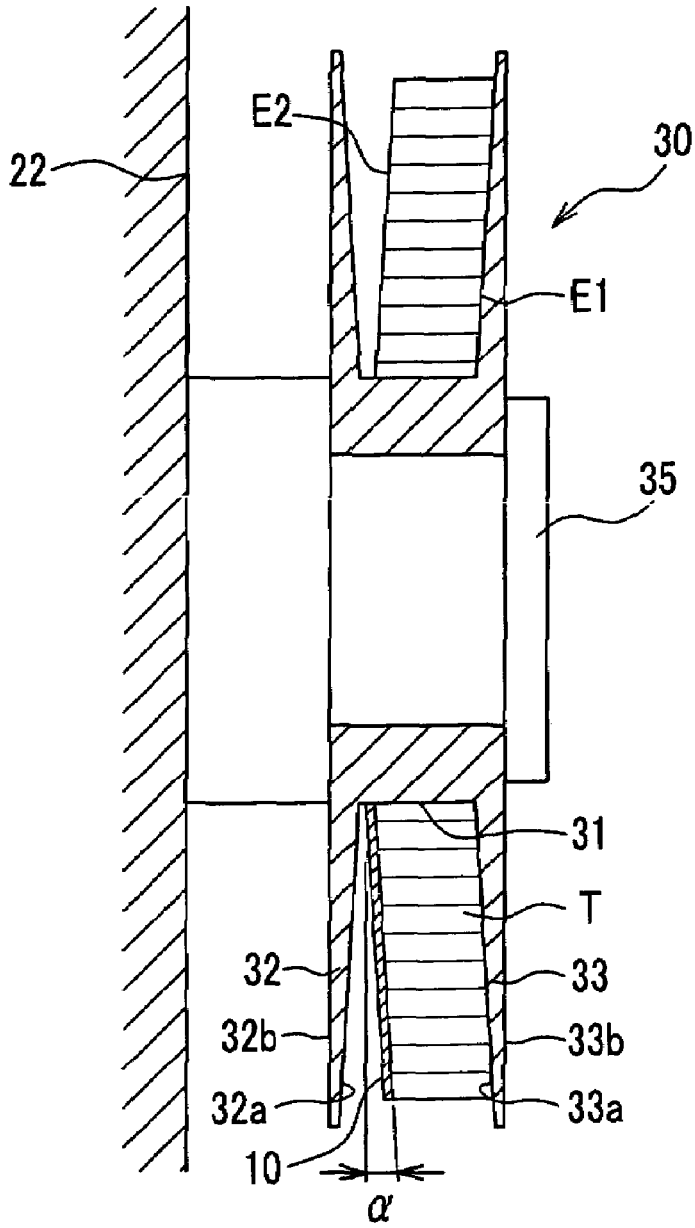
FIG. 3 is a cross sectional view along the line of A—A in FIG. 2, and shows the tape pack appearance at the time of the reel-up of the magnetic tape.

In the present embodiment, as shown in FIG. 1 and FIG. 3, guide rollers 11 and 12 are inclined at angle α, so that the reel-up of the magnetic tape T is performed in the condition that both edges of the magnetic tape T are touched with the tissue 10 and with the inner surface 33*a* of the flange 33.

Here, the slanting angle α of each guide rollers 11 and 12 is the same degree as that of the inner surface 33*a* of the flange 33.

In the present embodiment, the slanting angle α is established within the range of between 1 and 2 degree. Thereby, the tissue 10 that passes through the region between flanges 32 and 33 travels in parallel with the inner surface 33*a* of the flange 33.

In the tape pack appearance control apparatus 100, additionally, the pancake 20 and the tape reel 30 are fixed in parallel with a winder panel 22 by the fixtures 34 and 35, so that the reel-up of the magnetic tape T fed out from the pancake 20 onto the tape reel 30 may be performed with improved accuracy.

Next, the motion of the tape pack appearance control apparatus 100 will be explained.

Figure 2:
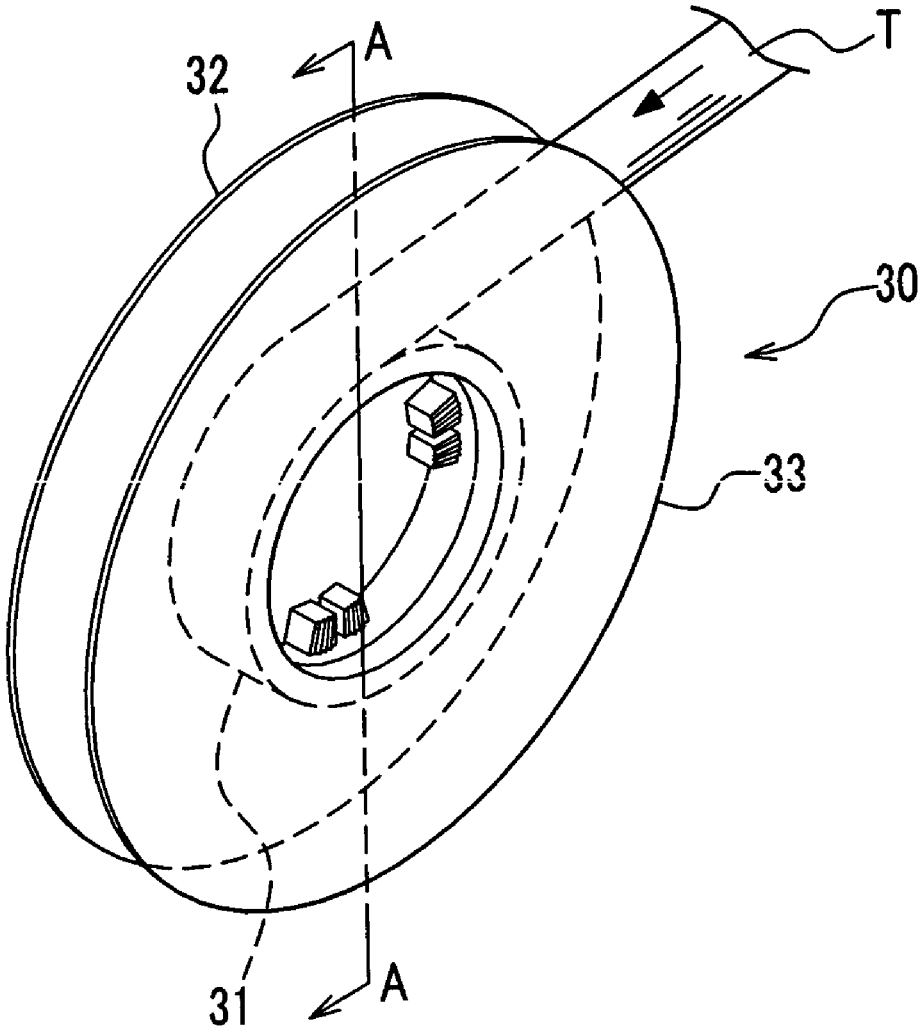
FIG. 2 is a perspective view showing the reel-up of the magnetic tape onto the tape reel is performed.

FIG. 2 is a perspective view showing the reel-up of the magnetic tape onto the tape reel that is in progress.

FIG. 3 is a cross sectional view along the line of A—A in FIG. 2, and shows the tape pack appearance at the time of the reel-up of the magnetic tape.

As shown in FIG. 2, when the reel-up of the magnetic tape T is started, the tape reel 30 is rotated in the anti clock-wise direction. Thereby, the magnetic tape T travels in the left direction (the direction indicated by the arrow). In this occasion, the reel-up of the magnetic tape T is performed without moving the tissue 10. In the present embodiment, the tissue 10 is moved at a predetermined length after terminating the reel-up of the magnetic tape T, and this movement of the tissue 10 is repeated whenever the reel-up of the magnetic tape T is terminated.

As shown in FIG. 1, guide rollers 11 and 12 are slanting at angle α, and the angle of inclination of each guide rollers 11 and 12 is same as that of inner surface 33*a* of the flange 33. Thus, as shown in FIG. 3, the tissue 10 between flanges 32 and 33 is kept in parallel condition with respect to the inner surface 33*a* of the flange 33. This brings the contact of the magnetic tape T with the tissue 10 and with the inner surface 33*a* of the flange 33. Thereby the magnetic tape T is wound onto a hub 31 of the tape reel 30 in the condition that both edges of the magnetic tape T are supported by the tissue 10 and inner surface 33*a*.

That is, the reel-up of the magnetic tape T is performed in the condition that the edge E1 of the magnetic tape T contacts with the flange 33, and that the edge E2 of the magnetic tape T contacts with the tissue 10.

In the present invention, therefore, the reel-up of the magnetic tape T is performed in the condition that the slip in the width directions of the magnetic tape T is controlled.

In the present invention, the inclination angle of guide rollers 11 and 12 may be determined so that the tissue 10 may be parallel with the inner surface 32*a* of the flange 32.

In this case, since tissue 10 becomes parallel with the inner surface 32*a*, the reel-up of the magnetic tape T is performed in the condition that the edge E1 of the magnetic tape T is supported by the tissue 10 and in the condition that the edge E2 of the magnetic tape T is supported by the inner surface 32*a*.

Figure 4:
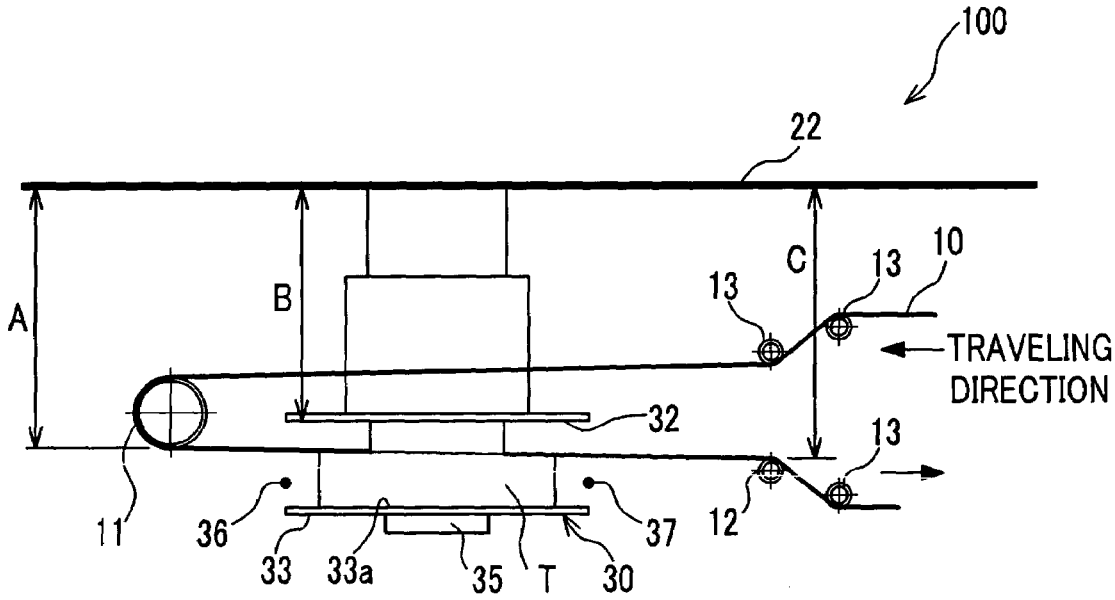
FIG. 4 is a plan view of the tape pack appearance control apparatus shown in FIG. 1.
Figure 5:
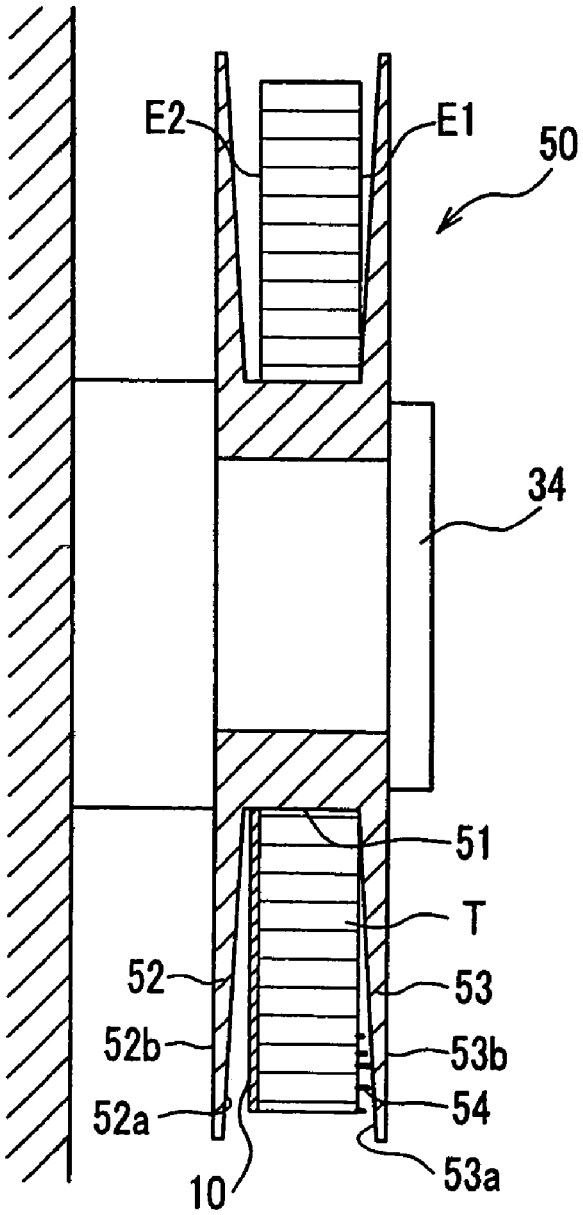
FIG.5 Prior Art
FIG. 5 is a cross sectional view of a tape reel, in which the tape T is being wound onto the reel hub 51 by using a conventional reel-up manner of a tape T.

Next, more detailed explanation of the reel-up of the magnetic tape T around a reel 30 will be carried out. FIG. 4 is a plan view of the tape pack appearance control apparatus shown in FIG. 1.

In this FIG. 4, each symbol A, B, and C indicates the distance between a winder panel 22 and the tissue 10. The amounts of these distances are used as an administrative value that is checked when the reel-up of the magnetic tape T is performed.

In the present embodiment, the tissue 10 is positioned between flanges 32 and 33, and pushes the edge E2 of the magnetic tape T toward the inner surface 33*a* of the flange 33 so that the edge E1 comes in contact with the inner surface 33*a*.

As can be seen in FIG. 4, the distance between the tissue 10 and the winder panel 22 is controlled so as to become progressively narrow toward the vicinity of the point 37 from the vicinity of the point 36. That is, the downstream side of the magnetic tape T is pushed toward the flange 33 with a greater force than upstream side of the magnetic tape T.

In the present embodiment, the distance between the tissue 10 and the flange 33 becomes narrow so that the force that pushes the magnetic tape T toward the flange 33 becomes progressively strong as the magnetic tape T moves from the vicinity of point 36 (upstream) to the vicinity of point 37 (downstream). In the present embodiment, therefore, distances A, B, and C become narrow in order of: C, A, B (B<A<C).

In the present invention, since the slip in the width directions of the magnetic tape T is controlled by the tissue 10 and the inner surface 33*a* of the flange 33, this allows the magnetic tape T to travel smoothly. Thereby, the occurrence of the distortion of the shape of the tape pack can be prevented even if the reel-up of the magnetic tape T is quickly performed.

Although there have been disclosed what are the patent embodiment of the invention, it will be understood by person skilled in the art that variations and modifications may be made thereto without departing from the scope of the invention, which is indicated by the appended claims.

For example, any inclination angle of guide rollers 11 and 12 may be acceptable as long as the tissue becomes in parallel with the inner surface of the flange of the tape reel.

In the present embodiment, a magnetic tape is used as an example of the tape. Any types of tape-like shaped recording mediums, such as an optical recording medium, can be adoptable in the present invention's apparatus.

What is claimed is:

1. An apparatus that improves the appearance of a tape being wound on a tape reel, the apparatus comprises:

a tissue which is positioned in parallel to an inner surface of a flange of the tape reel and pushes a tape edge of the tape against the inner surface, wherein the reel-up of the tape is performed without moving the tissue.

2. An apparatus that improves the appearance of a tape being wound on a tape reel according to claim 1, wherein the tissue is made of thin paper.

3. An apparatus that improves the appearance of a tape being wound on a tape reel according to claim 1, wherein the tissue is made of a finished fabric.

4. An apparatus that improves the appearance of a tape being wound on a tape reel according to claim 1, wherein the tissue is made of a nonwoven fabric.

5. An apparatus that improves the appearance of a tape being wound on a tape reel according to claim 1, wherein the tape is a magnetic tape.

6. An apparatus that improves the appearance of a tape being wound on a tape reel according to claim 1, wherein the tape is an optical recording tape.

7. The apparatus according to claim 1, wherein the tissue is moved a predetermined length after the reel-up of the tape is terminated.

8. The apparatus according to claim 1, further comprising a plurality of guide rollers inclined at an angle and guiding the tissue.

9. The apparatus according to claim 8, wherein the angle comprises 1 to 2 degrees.

10. The apparatus according to claim 8, wherein the angle of the plurality of guide rollers is the same as an incline of the inner surface of the flange.

11. An apparatus that improves the appearance of a tape being wound on a tape reel, the apparatus comprising:

a fixture, on which the tape reel is mounted and rotated, to wind the tape around the tape reel;

a tissue which is positioned between flanges of the tape reel and pushes a tape edge of the tape against one of the flanges; and a plurality of guide rollers, which are provided across the tape reel, and which adjust an inclination angle of the tissue such that the tissue is parallel to an inner surface of one of the flanges, and wherein the reel-up of tape is performed while moving the tissue in the same direction as the reel-up direction of the tape or performed without moving the tissue.

12. The apparatus that improves the appearance of a tape being wound on a tape reel according to claim 11, wherein a distance between the tissue and the inner surface of the flange becomes progressively narrow as the tape moves in parallel to the inner surface of the flange.

13. An apparatus that improves the appearance of a tape being wound on a tape reel according to claim 11, wherein the tissue is made of any one of thin paper, a finished fabric, and a nonwoven fabric.

14. An apparatus that improves the appearance of a tape being wound on a tape reel according to claim 11, wherein the tape is a magnetic tape or an optical recording tape.

* * * * *